US006213212B1

(12) United States Patent
Jenkins, Jr. et al.

(10) Patent No.: US 6,213,212 B1
(45) Date of Patent: Apr. 10, 2001

(54) SPHERICAL STEMMING PLUG AND METHOD OF USE

(75) Inventors: Sanford S. Jenkins, Jr.; Thomas S. Jenkins, both of Lee's Summit, MO (US)

(73) Assignee: Stemlock, Incorporated, Lee's Summit, MO (US)

( * ) Notice: Subject to any disclaimer, the term of this patent is extended or adjusted under 35 U.S.C. 154(b) by 0 days.

(21) Appl. No.: 09/359,604

(22) Filed: Jul. 23, 1999

(51) Int. Cl.[7] ..... E21B 27/00

(52) U.S. Cl. ..... 166/299; 299/13; 299/22; 102/304; 102/313; 102/322; 102/333

(58) Field of Search ..... 166/299; 299/10, 299/13, 22; 102/303, 304, 313, 322, 333

(56) References Cited

U.S. PATENT DOCUMENTS 4,637,312 * 1/1987 Adams et al. ..... 102/257.12
4,796,533 * 1/1989 Yunan ..... 102/322

OTHER PUBLICATIONS

"Rocklock"®, date unkown.

* cited by examiner

*Primary Examiner*—Roger Schoeppel
(74) *Attorney, Agent, or Firm*—Shook, Hardy & Bacon L.L.P.

(57) ABSTRACT

A method of stemming a borehole (6) includes the steps of placing a first layer (16) of stemming in the borehole, placing a spherical body (20) in the borehole on top of the layer (16), the body being relatively incompressible and a diameter slightly smaller than the diameter of the borehole, and placing a second layer (18) of stemming in the borehole over the body. The stemming (16, 18) may be placed in the borehole either in direct contact with an explosive (8), or spaced from it by a gas bag (24) or the like form a deck (22). In accordance with an alternate application, the stemming layers (16, 18) may be placed in the borehole prior to placement of an explosive material such that it serves as backfill. Preferably, the stemming includes crushed rock and drill cuttings such as those produced during formation of the borehole. However, other available materials may also be used such as gravel. The plug body is formed of a relatively incompressible material such as a ultra-high molecular weight polyethylene material, filled plastic shell, metal, ceramic or the like.

22 Claims, 1 Drawing Sheet

SPHERICAL STEMMING PLUG AND METHOD OF USE

CROSS-REFERENCE TO RELATED APPLICATIONS

"Not Applicable".

STATEMENT REGARDING FEDERALLY SPONSORED RESEARCH OR DEVELOPMENT

"Not Applicable".

BACKGROUND OF THE INVENTION

The present invention relates generally to a method of shattering earth formations by drilling boreholes in the formation and placing explosives therein which are detonated. More particularly, the invention relates to a method of plugging a borehole at any desired position in order to improve the performance of the explosives, and reduce the danger of fly rock and stemming ejection.

A conventional method of shattering earth formations in mining or excavation operations includes the steps of drilling a plurality of boreholes in the formation in a predetermined array, placing a predetermined amount of explosives in the boreholes, and detonating the explosives in a conventional sequence. Typically, the boreholes are not completely filled with explosives, but are plugged at the top by a stemming material such as crushed rock. In addition, the stemming at the tops of the boreholes may be spaced from the explosives by an air deck and/or other additional layers of air, explosives and stemming or plugging material.

Regardless of the number and arrangement of materials and decks in the boreholes, the upper layer of stemming is intended to plug the top of the borehole and confine the blast for a few extra milliseconds than would otherwise be the case in order to improve the cratering produced by the explosives and the fragmentation of material being shattered and to reduce dangerous fly rock and stemming ejection. As such, it is considered an important step in known processes to provide the stemming layer at the upper ends of the boreholes.

Although crushed rock is preferably used as the stemming material in mining and excavation operations, it is not always readily available, and must sometimes be shipped to the mining site for use. Because mining and site preparation is often conducted in urban locations, fly rock and stemming ejection can be dangerous. As such, there is a need for a stemming plug construction capable of use with readily available materials to prevent such dangerous conditions. Unfortunately, drill cuttings are much smaller than crushed rock, usually on the order of 6 mesh down to 200 mesh in size, and are easily blown from the boreholes upon detonation of the explosives. As such, very little confinement of the blast results, reducing the amount of cratering and fragmentation relative to that achieved when crushed rock is employed as the stemming material. The stemming plug in conjunction with crushed rock provides extra safety in confined areas where stemming ejection and fly rock can be dangerous.

BRIEF SUMMARY OF INVENTION

It is an object of the present invention to solve the technical problems left unaddressed by the prior art, and to provide a method of plugging boreholes in mining and excavation operations that employs readily available material without adversely affecting the amount of cratering and fragmentation and prevents dangerous conditions.

In accordance with these and other objects evident from the following description of a preferred embodiment of the invention, a method of plugging a borehole comprises the steps of placing a first layer of stemming in the borehole, placing a spherical body in the borehole on top of the stemming, and placing a second layer of stemming in the borehole over the body. The body includes a hard sphere and a diameter slightly smaller than the diameter of the borehole, and is preferably formed of a hard synthetic resin material such as ultra-high molecular weight polyethylene, or any material of similar minim hardness or a hard shell filled with a fluid, sand or other relatively hard material. The stemming preferably includes crushed rock but may include drill cuttings such as those produced during formation of the boreholes, ranging in size from about 6 mesh down to 200 mesh in size. However, gravel or other conventional stemming materials may also be employed in the method.

The borehole plug of the present invention preferably includes a first layer of stemming material adapted to be placed in the borehole, a second layer of stemming material adapted to be placed in the borehole above the first layer of stemming material, and a spherical body positioned between the first and second layers of stemming material, wherein the body is relatively hard and incompressible, and includes a diameter slightly smaller than that of the borehole in which the plug is to be used.

By providing a method and/or apparatus in accordance with the present invention, numerous advantages are realized. For example, by providing a method in which a pair of layers of stemming material are placed in a borehole with a relatively hard spherical body, a plug is defined in which the spherical body cooperates with the stemming material to prevent the stemming material from being ejected along the borehole during blasting. As such, the performance of the explosive material is comparable or better than with arrangements in which the stemming material is employed without the plug body.

BRIEF DESCRIPTION OF THE SEVERAL VIEWS OF THE DRAWING

The preferred embodiment of the present invention is described in detail below with reference to the attached drawing, wherein.

DETAILED DESCRIPTION OF THE INVENTION

Figure 1:
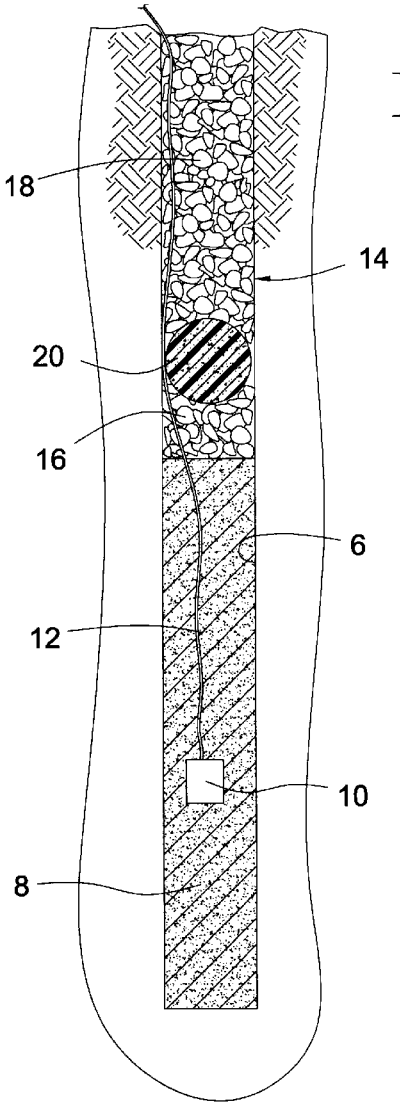
FIG. 1 is a schematic view of a borehole including explosives, a primer, and a plug constructed in accordance with the preferred embodiment.

A blasting arrangement constructed in accordance with the preferred embodiment of the invention is illustrated in FIG. 1, and broadly includes a borehole 6 formed in a material to be shattered, an explosive material 8 disposed in the bottom of the borehole, a primer 10 embedded in the explosive, a lead 12 extending from the primer to a conventional detonation controller, and a plug 14.

The borehole 6 is drilled into the material, and includes a diameter of about 7.62–40.64 cm (3–16 in). Typically, the drilling process generates drill cuttings ranging in size from about 6 mesh to 200 mesh, which are removed from the borehole during formation. These cuttings may be used as stemming, decking, or backfill in a manner described below.

The explosive material 8 is of known composition, e.g. ammonium nitrate fuel oil or the like, and is placed in the borehole 6 in a conventional fashion to a desired height. In the illustrated embodiment, the borehole is 3 m (10 ft) deep, and the explosive material 8 is filled to a height of 1.8 m (6 ft) from the bottom of the borehole. The primer 10 is lowered into the borehole during placement of the explosive material, with the lead 12 protruding from the borehole for connection to the detonation controller. The primer 10 and lead 12 are also of conventional construction. For example, a pentalite primer may be used such as that offered under the trademark "TROJAN™".

The plug 14 broadly includes first and second layers 16, 18 of stemming material, and a spherical body 20 interposed between the layers. The stemming material is preferably comprised of crushed rock but may include the drill cuttings produced during drilling of the boreholes at the site being mined or excavated, but may also include other materials such as gravel and the like. The primary advantage of using the drill cuttings is their availability and low cost relative to that of crushed rock or any other material that must be transported to the site for use.

Figure 2:
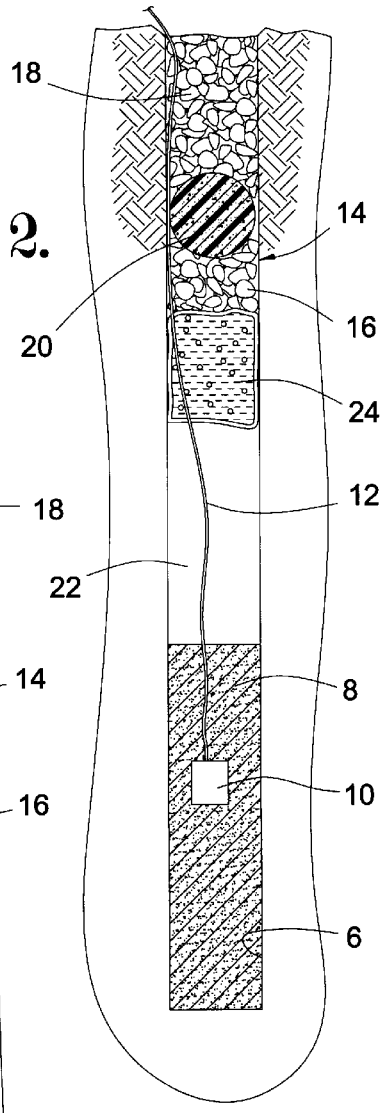
FIG. 2 is a schematic view of a borehole including explosives, a primer, an air deck, a gas bag, and a plug constructed in accordance with the preferred embodiment.

The spherical body 20 of the plug is formed of any material or combination of materials that presents a relatively hard, incompressible mass that can be placed in the borehole and substantially retain its spherical shape upon detonation of the explosive material. A preferred material for use in the body is ultra-high molecular weight polyethylene, which possesses a hardness greater than about R50 using the Rockwell hardness test. Other synthetic resin materials may be used that are not as hard as ultra-high molecular weight polyethylene so long as they substantially hold their shape through detonation, or are formed in a shell that is filled with a relatively incompressible material such that the body holds its shape, as shown in FIG. 2.

Although ultra-high molecular weight polyethylene is the preferred material for use in forming the spherical body, other materials exhibiting suitable hardness may also be employed. For example, metals and ceramic materials or plastic shells filled with water, sand, foamed synthetic resins or other incompressible material may be suitable so long as they do not substantially deform upon detonation of the explosive material.

The method used to form the spherical body depends on the material used, but may be carried out with most materials by shaping the material on a lathe, injection molded or the like. However, it is understood that the method used to construct the body is not critical to the performance of the plug, and that any method of construction may be employed.

In order to plug the borehole, the first layer of stemming is placed in the borehole over the explosive material to a depth of about ¼ of the total stemming, and the spherical body is dropped into the borehole over the first layer 16. In an exemplary embodiment, the borehole includes a diameter of 7.62 cm (3 in), and the spherical body of the plug includes an outer diameter of 6.985 cm (2.75 in). As such the spherical body can be dropped into the bore without any special alignment or effort. Once the spherical body is placed on top of the first level of stemming material, the remaining space above the body is filled with additional stemming material 18. The layer of stemming material underlying the body protects the body from heat generated during blasting, and acts as the first blockage achieved by the plug.

With reference to FIG. 2, the plug 14 should not be placed in the borehole immediately over the explosive material. It is also possible to employ the plug 14 in an arrangement including one or more air decks 22. In order to construct this arrangement, the explosives 8 and primer 10 are placed in the same manner as described above with reference to FIG. 1, with the exception that less explosive material need be placed in the borehole than would be required in the absence of the air deck. Once placement of the explosive material and primer is complete, a gas bag 24 or other conventional device is lowered into the borehole and inflated, filled or otherwise engaged with the wall of the borehole 6 to define a space between the bag and the upper surface of the explosive material. Although the deck 22 is illustrated as being an air deck, other materials may be used to form the deck, e.g. dirt or stemming material.

Once the gas bag 24 is secured in the borehole, the plug 14 is constructed by placing first and second layers 16, 18 of stemming material in the borehole with the spherical body 20 interposed between the layers, just as described above with reference to the arrangement of FIG. 1.

Figure 3:
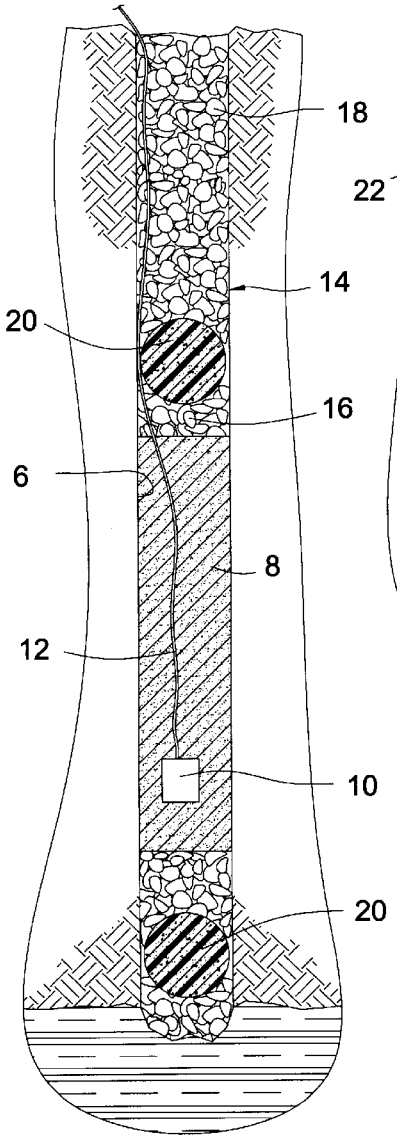
FIG. 3 is a schematic view of a borehole including explosives, a primer, a backfill plug, and a stemming plug constructed in accordance with the preferred embodiment.

An alternate placement of the plug 14 is illustrated in FIG. 3, and includes using the plug at the bottom of the borehole as backfill in order to prevent coal or other material disposed beneath the material to be shattered from being crushed or chilled by the blasting. In order to use the plug 14 in this environment, a first layer 16 of stemming material is placed in the borehole 6 prior to placement of the explosive material 8 in order to backfill the borehole to the top of the material to be protected. Thereafter, the plug body 20 is dropped into the borehole and the second layer 18 of stemming material is placed over the body to a height of several inches.

When used as a backfill plug, the upper layer 18 of stemming material protects the plug body 20 from the heat of the blast, and the body engages the stemming material of the lower layer 16 to plug the bottom end of the borehole and prevent the underlying material from being crushed or chilled.

Although the present invention has been described with reference to the preferred embodiment illustrated in the attached drawing figures, it is noted that substitutions may be made and equivalents employed herein without departing from the scope of the invention. For example, although the plug 14 is illustrated as being used to plug either the top or bottom end of a borehole, it may also be used to plug the borehole at other locations to separate decks or layers of materials placed in the borehole, or to block off portions of the borehole from other portions. In each instance, the spherical body 20 cooperates with the stemming material 16, 18 to prevent the stemming material from being ejected along the borehole during blasting, improving the performance of the explosive relative to arrangements in which the stemming material is employed without the plug body.

What is claimed is:

1. A method of plugging a borehole comprising the steps of:

placing a first layer of stemming material in the borehole;

placing a spherical body in the borehole on top of the first layer of stemming material, and placing a second layer of stemming material in the borehole over the body.

2. The method as recited in claim 1, wherein the first layer of stemming material is placed in the borehole subsequent to placement of an explosive material in the borehole.

3. The method as recited in claim 2, wherein the first layer of stemming material is placed in contact with the explosive material in the borehole.

4. The method as recited in claim 2, wherein the first layer of stemming material is spaced from the explosive material by a deck.

5. The method as recited in claim 2, wherein a gas bag is interposed between the explosive material and the layers of stemming material in the borehole.

6. The method as recited in claim 1, wherein the second layer of stemming material is placed in the borehole prior to placement of an explosive material in the borehole.

7. The method as recited in claim 6, wherein the explosive material is placed in contact with the second layer of stemming material.

8. The method as recited in claim 1, wherein drill cuttings are produced during formation of the borehole and are used as the stemming material.

9. The method as recited in claim 8, wherein the drill cuttings range from about 6 mesh down to 200 mesh in size.

10. The method as recited in claim 1, wherein the stemming material is selected from the group consisting of gravel and crushed rock.

11. The method as recited in claim 1, wherein the body includes a shell formed of ultra-high molecular weight polyethylene.

12. A method of plugging a borehole during blasting, comprising the steps of:

placing a first layer of stemming material in the borehole;

placing a spherical body in the borehole on top of the first layer of stemming material, the body being formed of a material that substantially retains its shape during blasting; and placing a second layer of stemming material in the borehole over the body.

13. A borehole plug adapted for use in a borehole having a diameter of greater than about 6.35 cm (2.5 in), the plug comprising:

a first layer of stemming material adapted to be placed in the borehole;

a second layer of stemming material adapted to be placed in the borehole above the first layer of stemming material; and a spherical body positioned between the first and second layers of stemming material.

14. The borehole plug as recited in claim 13, wherein the spherical body has a diameter greater than about 7.62 cm (3 in).

15. The borehole plug as recited in claim 13, wherein the body is formed of synthetic resin material.

16. The borehole plug as recited in claim 13, wherein the body is formed of ultrahigh molecular weight polyethylene.

17. The borehole plug as recited in claim 13, wherein the body is formed of metal.

18. The borehole plug as recited in claim 13, wherein the body is solid.

19. The borehole plug as recited in claim 13, wherein the body is hollow, the plug further comprising an incompressible material enclosed within the body.

20. The borehole plug as recited in claim 13, wherein the stemming material is drill cuttings ranging from about 6 mesh down to 200 mesh in size.

21. The borehole plug as recited in claim 13, wherein the stemming material is gravel.

22. The borehole plug as recited in claim 13, wherein the body is formed of a ceramic material.

* * * * *